US005623919A

United States Patent [19]

Kelly

[11] Patent Number: 5,623,919

[45] Date of Patent: Apr. 29, 1997

[54] CAMPFIRE REFLECTIVE SHEET

[76] Inventor: Michael P. Kelly, 87 Des Parulines, Hull, Quebec, Canada, J9A 1Z3

[21] Appl. No.: 596,521

[22] Filed: Feb. 5, 1996

[30] Foreign Application Priority Data

Feb. 24, 1995 [CA] Canada ..... 2143398

[51] Int. Cl.[6] ..... A61F 7/00

[52] U.S. Cl. ..... 126/204; 126/552; 359/838

[58] Field of Search ..... 359/838, 850; 126/552, 204, 680

[56] References Cited

U.S. PATENT DOCUMENTS

| | | | |
|---|---|---|---|
| 4,329,978 | 5/1982 | Wormser et al. | 359/823 |
| 5,263,468 | 11/1993 | Powell | 126/204 |
| 5,375,016 | 12/1994 | Hongo | 359/850 |

FOREIGN PATENT DOCUMENTS

| | | | |
|---|---|---|---|
| 2044914 | 10/1980 | United Kingdom | 126/204 |

*Primary Examiner*—Carroll B. Dority

[57] ABSTRACT

When a person is sitting in a chair facing an outdoor campfire, the radiant heat created from the fire can only be felt on parts of a person's body directly exposed to the fire. Other parts of the body not directly exposed to the radiant heat, such as a person's rear thighs and back, will often feel cold in cool environmental conditions. Using the radiant heat generated from a campfire, a flexible sheet with a textured reflective surface, attached to the top rail backrest of a chair and to the bottom rail between the two front legs of a chair forming a curve or an arc under the chair, will reflect the radiant heat in an upward direction warming those parts of a person's body not normally receiving heat. The sheet is shaped to fit between the rear legs of generally any typical outdoor folding chair.

3 Claims, 2 Drawing Sheets

CAMPFIRE REFLECTIVE SHEET

SPECIFICATIONS

This invention is to provide warmth to parts of a person's body not normally exposed to radiant heat generated from a campfire when sitting in a typical outdoor folding chair, facing the fire.

In cool environmental conditions, parts of a person's body not facing the radiant heat from a campfire will feel cold and uncomfortable. An attempt to overcome this, would be to wear more clothing or to wrap oneself in a blanket. However, there will always be a temperature difference between parts of the body facing the radiant heat and the parts not facing the radiant heat from a campfire. Another way would be to remain in a standing position and constantly rotate oneself, thereby intermittently exposing most parts of the body to the radiant heat; however this would not compare to the comfort of sitting in a chair.

To overcome the cold discomfort while remaining seated in a chair, I have found that by placing a reflective sheet under a chair extending from the top rail backrest of the chair to the bottom rail between the two front legs of the chair, forming any arc or curved shape, will reflect radiant heat generated from a campfire to the parts of a person's body not normally receiving the radiant heat.

The principle is to capture the heat generated from a campfire and to uniformly reflect it in a dispersed manner to the colder parts of a person's body, thus avoiding any concentration of heat to any particular spot. It is therefore necessary for the reflective sheet to have a multitude of miniature concave or convex shapes, to ensure that the heat from the campfire is dispersed. A multitude of concaved or convexed shapes (ie: grid pattern or diamond shaped patterns) will also increase the amount of radiant heat collected and dispersed.

The reflective sheet is attached to the top rail backrest of the chair, and to the bottom rail between the two front legs of the chair, with a simple snap-on attachment over the horizontal rails. The snap-on attachment is sized and flexible to fit over any large or small sized chair rail. The tightness or looseness of the attachements would not affect the performance of the reflective sheet, as long as they hold in place to form any curve under the chair passing between the two rear legs of the chair reflecting heat in an upward direction. For chairs with no bottom rail between the two front legs, a tubular member extending beyond the edge of the two front legs of the chair, can be snapped on the sheet attachment and form the bottom horizontal rail.

The reflective sheet is reduced in width where it must fit between the two rear legs of a chair. This is to allow the said sheet to be adaptable to any outdoor folding chair which may have a narrower space between the two rear legs. When not in use, the reflective sheet can easily be rolled for storage. A velcro or string attachment will maintain the sheet firmly rolled.

DRAWINGS

In the drawings which illustrate embodiments of the invention,

Figure 1:
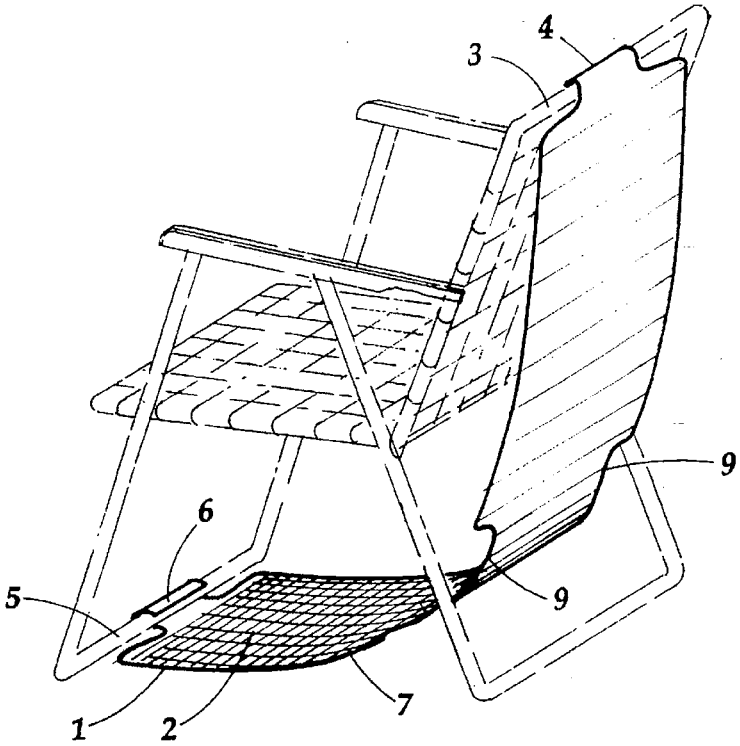
FIG. 1 is an isometric, illustrating the principle of the invention attached to a typical outdoor folding chair.
Figure 2:
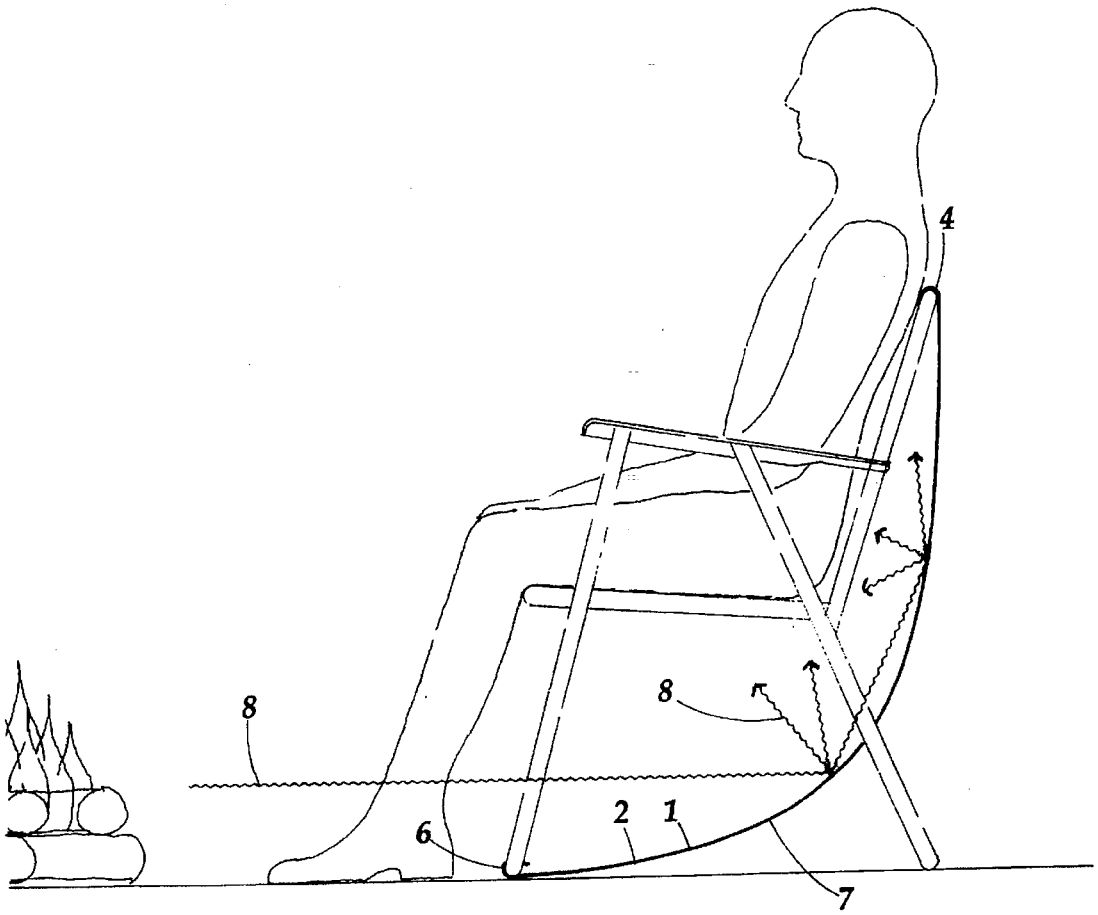
FIG. 2 is a side elevation, illustrating the principle direction of reflected radiant heat when dispersed from the sheet.
Figure 3:
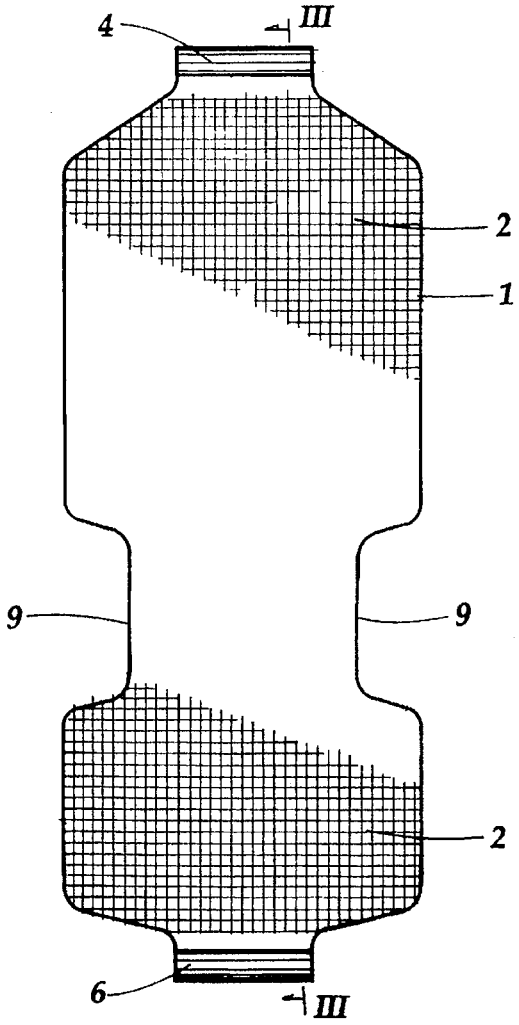
FIG. 3 is an elevation of the reflective sheet, seen in a vertical plane.
Figure 4:
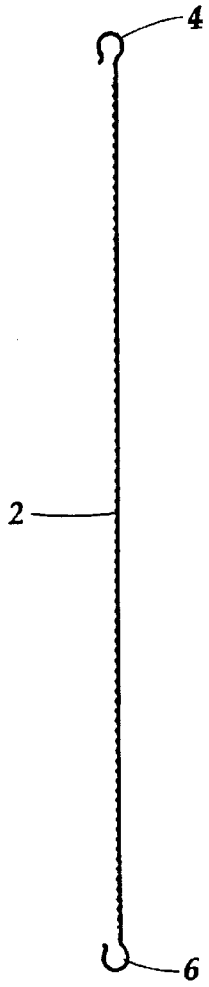
FIG. 4 is a section of the line III—III of FIG. 3, seen in a vertical plane.
Figure 5:
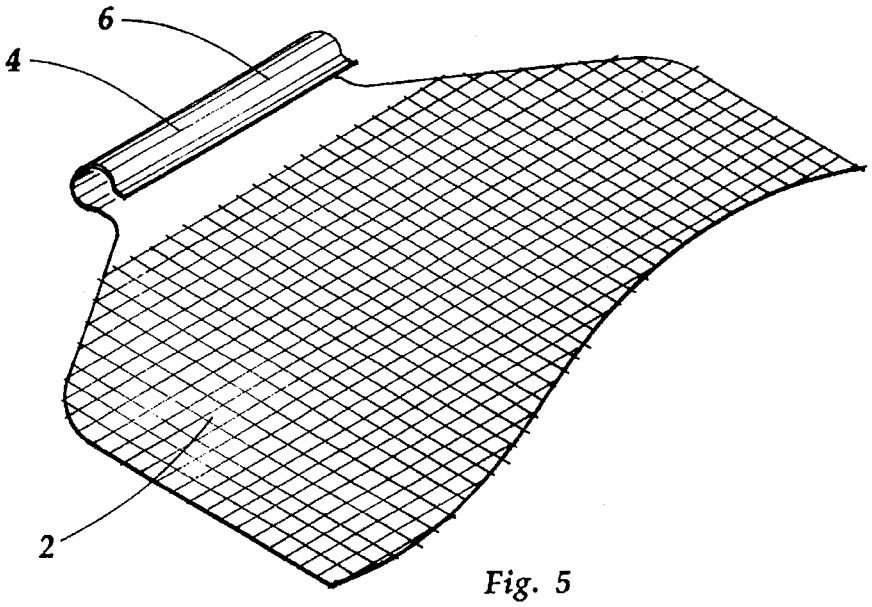
FIG. 5 is a larger scale perspective view of the top and bottom attachments.

The invention comprises a flexible reflective sheet 2 composed of a multitude of concave or convex reflective shapes 2. The reflective sheet is secured to the top rail backrest of the chair 3 with a flexible snap-on attachment 4. The reflective sheet is also secured to the bottom horizontal tubular rail 5 of the chair between the two front legs with another flexible snap-on attachment 6, identical to the top attachment 4. Once the reflective sheet 1 is attached to the top rail 3 and bottom rail 5 of the chair, a natural curve 7 is formed to capture and reflect the radiant heat 8 from the campfire in an upward direction. The reflective sheet is reduced in width 9 to fit between the two rear legs of chairs with limitted space.

The embodiments of the invention in which an exclusive property or privilege is claimed are defined as follows:

1. A flexible sheet comprising of a multitude of concave or convex reflective shapes on its surface with attachments at both ends, to be attached to a chair having a horizontal rail at the top of the backrest and a lower horizontal rail between the two front legs, where when it is attached to the chair, a curve or an arc is formed under the chair, to uniformly disperse the radiant heat generated from a campfire in an upward direction, warming those parts of a person's body not normally receiving heat.

2. A flexible reflective sheet as defined in claim 1 in which the attachments snap-on to the top and bottom rails of a chair, and which are flexible enough to fit over large or small tubular members.

3. A flexible reflective sheet as defined in claim 1 or claim 2 in which the sheet is reduced in width so that when attached to a chair, the sheet will fit between the two rear legs of chairs where the space between the those two legs is limitted.

* * * * *